US005136799A

United States Patent [19]

Knappick et al.

[11] Patent Number: 5,136,799

[45] Date of Patent: Aug. 11, 1992

[54] AUTOMATIC OPEN AND CLOSE SIGN

[76] Inventors: Alvin Knappick, 3637 Cheryl La., Fort Worth, Tex. 76117; George Spector, 233 Broadway Rm 3815, New York, N.Y. 10007

[21] Appl. No.: 654,038

[22] Filed: Feb. 12, 1991

[51] Int. Cl.[5] ..... G09F 11/02

[52] U.S. Cl. ..... 40/505; 40/493; 40/503

[58] Field of Search ..... 40/505, 503, 597; 192/95; 74/625

[56] References Cited

U.S. PATENT DOCUMENTS

| | | | |
|---|---|---|---|
| 469,487 | 0/0000 | Wallace | 40/597 |
| 1,399,038 | 12/1921 | Valois | 74/625 |
| 2,277,323 | 3/1942 | Hjermstad | 40/505 |
| 2,501,008 | 3/1950 | Schram | 192/95 |
| 2,717,759 | 9/1955 | Schofield et al. | 74/625 |
| 3,109,251 | 11/1963 | Krueger | 40/503 |
| 3,229,395 | 1/1966 | Belisle | 40/505 |
| 3,798,811 | 3/1974 | Rockola | 40/505 |
| 4,073,081 | 2/1978 | Hunter, Jr. | 40/505 |
| 4,168,587 | 9/1979 | Falk | 40/505 |
| 4,189,859 | 2/1980 | Ahlgren | 40/505 |
| 4,771,558 | 8/1988 | Roberts et al. | 40/505 |
| 4,779,485 | 10/1988 | Dollison et al. | 74/625 |
| 4,893,557 | 1/1990 | Benthake et al. | 74/625 |

FOREIGN PATENT DOCUMENTS

| | | | |
|---|---|---|---|
| 1525572 | 8/1978 | United Kingdom | 40/505 |

*Primary Examiner*—Laurie K. Cranmer
*Assistant Examiner*—Cassandra Hope

[57] ABSTRACT

An automatic and manually operated open-closed sign is provided that will include a timed motor to operate rotatable slats having the words "OPEN" and "CLOSED" printed on each side. A manual override is also provided so that the sign can be operated directly by a person.

1 Claim, 1 Drawing Sheet

AUTOMATIC OPEN AND CLOSE SIGN

BACKGROUND OF THE INVENTION

The instant invention relates generally to display devices and more specifically it relates to an automatic and manually operated open-closed sign which provides a system that can automatically operate the sign by a timed motor or manually by a knob.

There are available various conventional display devices which do not provide the novel improvements of the invention herein disclosed.

SUMMARY OF THE INVENTION

A primary object of the present invention is to provide an automatic and manually operated open-closed sign that will overcome the shortcomings of the prior art devices.

Another object is to provide an automatic and manually operated open-closed sign that eliminates the daily hassle of having a flip or turn an open and closed sign by business people.

An additional object is to provide an automatic and manually operated open-closed sign that will include a timer and motor built into the sign which is set for the time opening and time closing, while also having a manual override so that the sign can be operated directly by a person.

A further object is to provide an automatic and manually operated open-closed sign that is simple and easy to use.

A still further object is to provide an automatic and manually operated open-closed sign that is economical in cost to manufacture.

further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS FIGURES

DETAILED DESCRIPTION OF THE PREFERRED EMBODIMENTS

Figure 1:
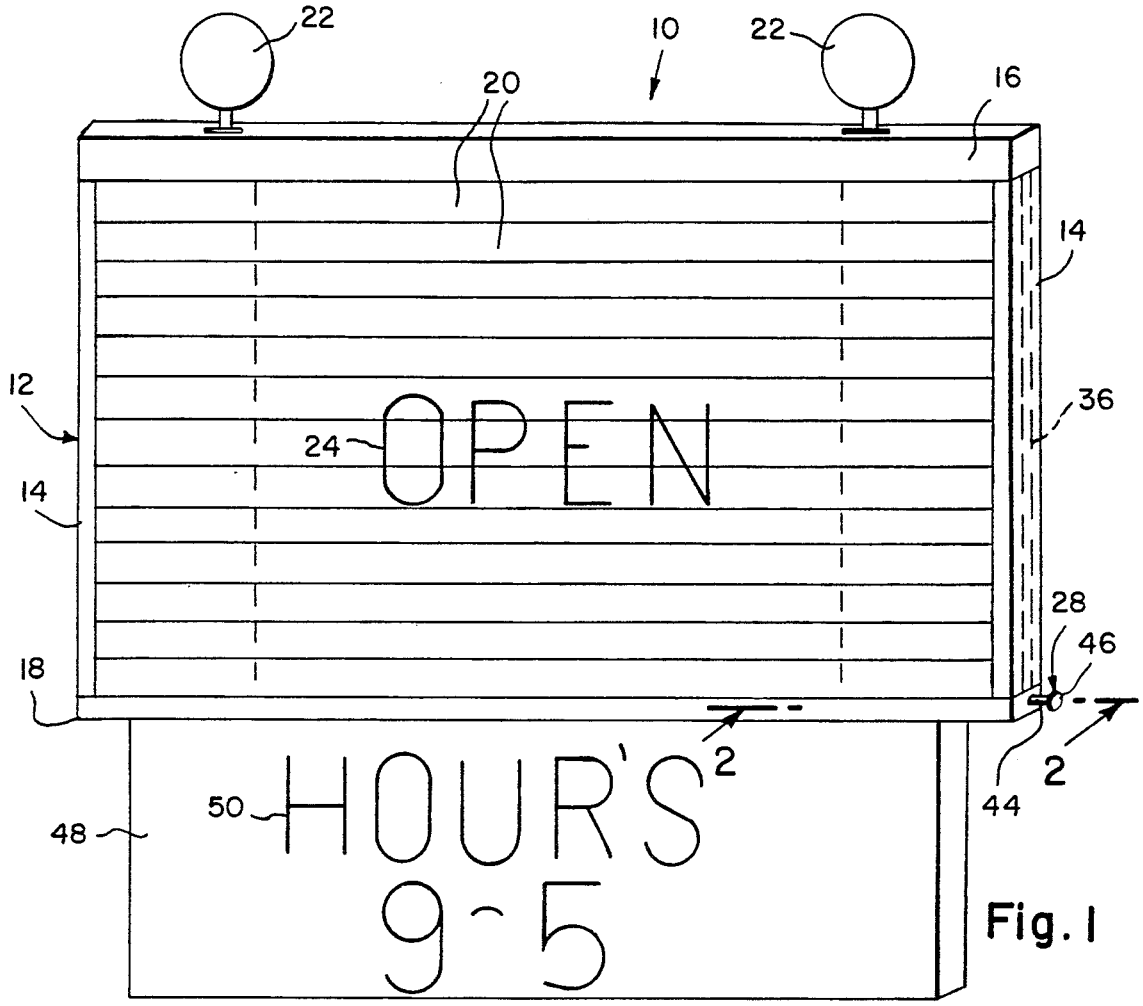
FIG. 1 is a perspective view of the instant invention.
Figure 2:
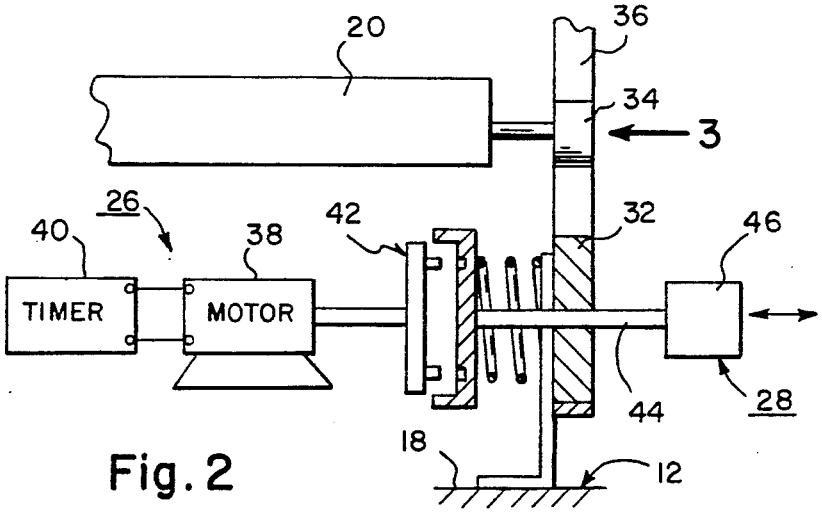
FIG. 2 is a diagrammatic cross section taken along line 2—2 in FIG. 1, showing the manual and automatic mechanism within the bottom rail.
Figure 3:
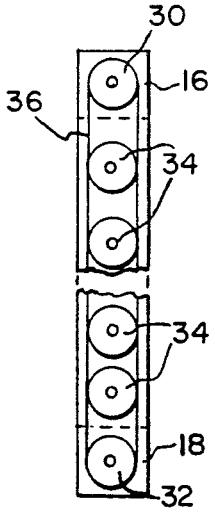
FIG. 3 is a diagrammatic end view taken in direction of arrow 3 in FIG. 2, show in the continuous belt and cooperating pulleys therewith.

Turning now descriptively to the drawings, in which similar reference characters denote similar elements throughout the several views, the Figures illustrate an automatic and manually operated open-closed sign 10 consisting of a frame 12 having a pair of side rails 14, a top rail 16 and a bottom rail 18. A plurality of spaced apart horizontal blind slats 20 are rotatably carried between the side rails 14 of the frame 12. A a pair of suction cups 22 are spaced apart and affixed to the top rail 16 of the frame 12 so that the suction cups 22 can be removably attached to a glass allowing said frame 12 to hang therefrom. Indicia 24, such as the word "OPEN" is printed across one side of some of the blind slats 20 and the word "CLOSED" is printed across the opposite side of some of the blind slats 20. A mechanism 26 is provided for automatically rotating the blind slats 20 within the frame 12 at predetermined timed intervals so as to indicated in one instance the indicia 24 as the word "OPEN", and in another instance the indicia 24 as the word "CLOSED". Another mechanism 28 is or disengaging the automatic mechanism 26, for manually rotating the blind slats 20 within the frame 12 indicate in one instance the indicia 24 as the word "OPEN" and in other instance the indicia 24 as the word "CLOSED".

The automatic mechanism 26 includes an upper pulley 30 rotatably carried in one end of the top rail 16 of the frame 12. A lower pulley 32 is rotatably carried in one end of the bottom rail 18 of the frame 12 directly below the upper pulley 30. A plurality of blind pulleys 34 are provided with each connected to one end of each blind slat 20 on the same side as the upper pulley 30 and the lower pulley 32. A continuous belt 36 extends about the upper pulley 30, the lower pulley 32 and the bind pulleys 34. A reversible motor 38 is coupled to the lower pulley 32 to rotate all o the blind slats 20 together. A time 40 is electrically connected to the motor 38 so as to operate the motor 38 at the predetermined timed intervals.

The manual mechanism 238 includes a spring biased closed clutch 42 coupled between the motor 38 and the lower pulley 32. A square shaped shaft 44 extends from one side of the clutch 42 through the lower pulley 32 and out of the bottom rail 18 of the frame 12. An enlarged knob 46 is affixed to the distal end o the square shaped shaft 44. A person can pull the knob 46 to slide the square shaped shaft 44 outwardly to disengage the clutch 42 and then turn manually the lower pulley 32 to rotate all of the blind slats 20 together.

The automatic and manually operated open-closed sign 10 further includes a panel 48 affixed vertically to the underside of the bottom rail 18 of the frame 12 and indicia 50, such as the words "HOURS 9–5" to indicate the time the place is opened.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An automatic and manually operated open-closed sign comprising:

a) a frame having a pair of side rails, a top rail and a bottom rail;

b) a plurality of spaced apart horizontal blind slats rotatably carried between the side rails of said frame;

c) a pair of suction cups spaced apart and affixed to the top rail of said frame so that said suction cups can be removably attached to a glass allowing said frame to hang therefrom;

d) indicia such as the word "OPEN" printed across one side of some of said blind slates and the word "CLOSED" printed across the opposite side of some of said blind slats;

e) means for automatically rotating said blind slats within said frame at predetermined timed intervals so as to indicate in one instance said indicia as the word "OPEN" and in another instance said indicia as the word "CLOSED";

f) manual means for disengaging said automatic means and for manually rotating said blind slats within said frame to indicate in one instance said indicia as the word "OPEN" and in another instance said indicia as the word "CLOSED";

g) an upper pulley rotatably carried in one end of the top rail of said frame;

h) a lower pulley rotatably carried in one end of the bottom rail of said frame directly below said upper pulley;

i) a plurality of blind pulleys, each connected to one end of each said blind slat on the same side as said upper pulley and said lower pulley;

j) a continuous belt extending about said upper pulley, said lower pulley and said blind pulleys;

k) a reversible motor coupled to said lower pulley to rotate all of said blind slats together; and l) a timer electrically connected to said motor so as to operate said motor at the predetermined timed intervals; wherein said manual means includes:

m) a spring biased closed clutch coupled between said motor and said lower pulley;

n) a shaft extending from one side of said clutch coupled to and extending slidably through said lower pulley and out of the bottom rail of said frame; and o) a knob affixed to the distal end of said shaft so that person can pull said knob to slide said shaft outwardly to disengage said clutch and then turn manually said lower pulley to rotate all of said blind slats together.

* * * * *